United States Patent [19]

Swindlehurst

[11] Patent Number: 4,979,544

[45] Date of Patent: Dec. 25, 1990

[54] UNIVERSAL WIRE HARNESS FORM BOARD ASSEMBLY

[75] Inventor: William S. Swindlehurst, Philadelphia, Pa.

[73] Assignee: The Boeing Company, Seattle, Wash.

[21] Appl. No.: 252,487

[22] Filed: Sep. 30, 1988

[51] Int. Cl.[5] ..... B21F 27/12

[52] U.S. Cl. ..... 140/92.1; 29/755

[58] Field of Search ..... 140/92.1, 93 R; 29/755, 29/850

[56] References Cited

U.S. PATENT DOCUMENTS

| | | | |
|---|---|---|---|
| 3,633,096 | 1/1972 | Bollman | 324/51 |
| 3,653,411 | 4/1972 | Mosher et al. | 140/92.1 |
| 3,693,228 | 9/1972 | Logan | 29/203 |
| 3,946,768 | 7/1976 | Florentino | 140/92.1 |
| 4,867,207 | 9/1989 | Crawford | 140/92.1 |

FOREIGN PATENT DOCUMENTS

| | | | |
|---|---|---|---|
| 621025 | 8/1978 | U.S.S.R. | 29/755 |
| 903992 | 2/1982 | U.S.S.R. | 29/755 |
| 928688 | 5/1982 | U.S.S.R. | 29/755 |

*Primary Examiner*—Lowell A. Larson

*Attorney, Agent, or Firm*—Jones, Tullar and Cooper

[57] ABSTRACT

A form board assembly for universal wire harness fabrication has one or two boards each including a plurality of openings within which a routing pin is situated and a reciprocally movable. The reciprocal movement is effected by an actuating assembly which selectively displaces the routing pins in their respective openings forming thereby an arrangement of displaced routing pins in accordance with a given wire harness design.

21 Claims, 6 Drawing Sheets

UNIVERSAL WIRE HARNESS FORM BOARD ASSEMBLY

BACKGROUND OF THE INVENTION

The present invention relates to the field of wire harness fabrication, and in particular to a form board assembly for use in fabricating wire harnesses of varying configurations.

At the present time, each wire harness of a given configuration fabricated in a wire shop requires a customized form board for lay-up. The form board typically includes a plurality of fixed routing pins which together define the given configuration. Quite clearly, one form board for one wire harness configuration involves high costs when many wire harness configurations must be dealt with. The costs result from the need to create, maintain, store and set-up these form boards when a particular wire harness configuration must be fabricated.

An object of the present invention is to provide a single form board assembly which can be used for fabricating any number of wire harnesses of differing configurations.

SUMMARY OF THE INVENTION

A form board assembly for fabricating wire harnesses of varying configurations has been developed. The form board assembly includes a board having an array of routing pins mounted to the board for displaceable movement relative to the board so that their relative height can be adjusted. The adjustment can be effected manually or by the use of a programmable controller interfaced to a host computer.

The number of routing pins mounted to the board is sufficient in number to enable the fabrication of any number of wire harnesses The wire harness design dictates which pins are needed and which are not. Through either the manual or the programmable controller the desired number of routing pins have their height adjusted from a retracted position to an intermediate or maximum extended position. Once the routing pins are adjusted in accordance with the wire harness design, they are locked in their extended position. The form board is now ready for the wire harness fabrication in accordance with the particular wire harness design.

Once the particular wire harness fabrication is completed, the extended routing pins can be unlocked and returned to theIr retracted position. The board is then ready to have the routing pins adjusted for another wire harness configuration.

The wire harness fabrication can take place at the form board assembly location, or the form board, once configured to a particular wire harness design, can be removed from the form board assembly and the fabrication completed elsewhere. After the completion of the wire harness fabrication the form board is return to the form board assembly for further configuring, as noted above.

The present invention also envisions a form board assembly having two form boards, one configured according to a particular wire harness design and the other requiring configuration. In this way, while the wire harness fabrication is in process, another wire harness design is being configured on the other form board.

BRIEF DESCRIPTION OF THE DRAWINGS

Nine figures have been selected to illustrate several preferred embodiments of the present invention. Some of these figures are schematic in nature. All of these figures, however, when taken together with the written description are sufficient to enable a person skilled in the art to practice the invention. Included are.

DETAILED DESCRIPTION OF THE PREFERRED EMBODIMENTS

Figures 1, 3:
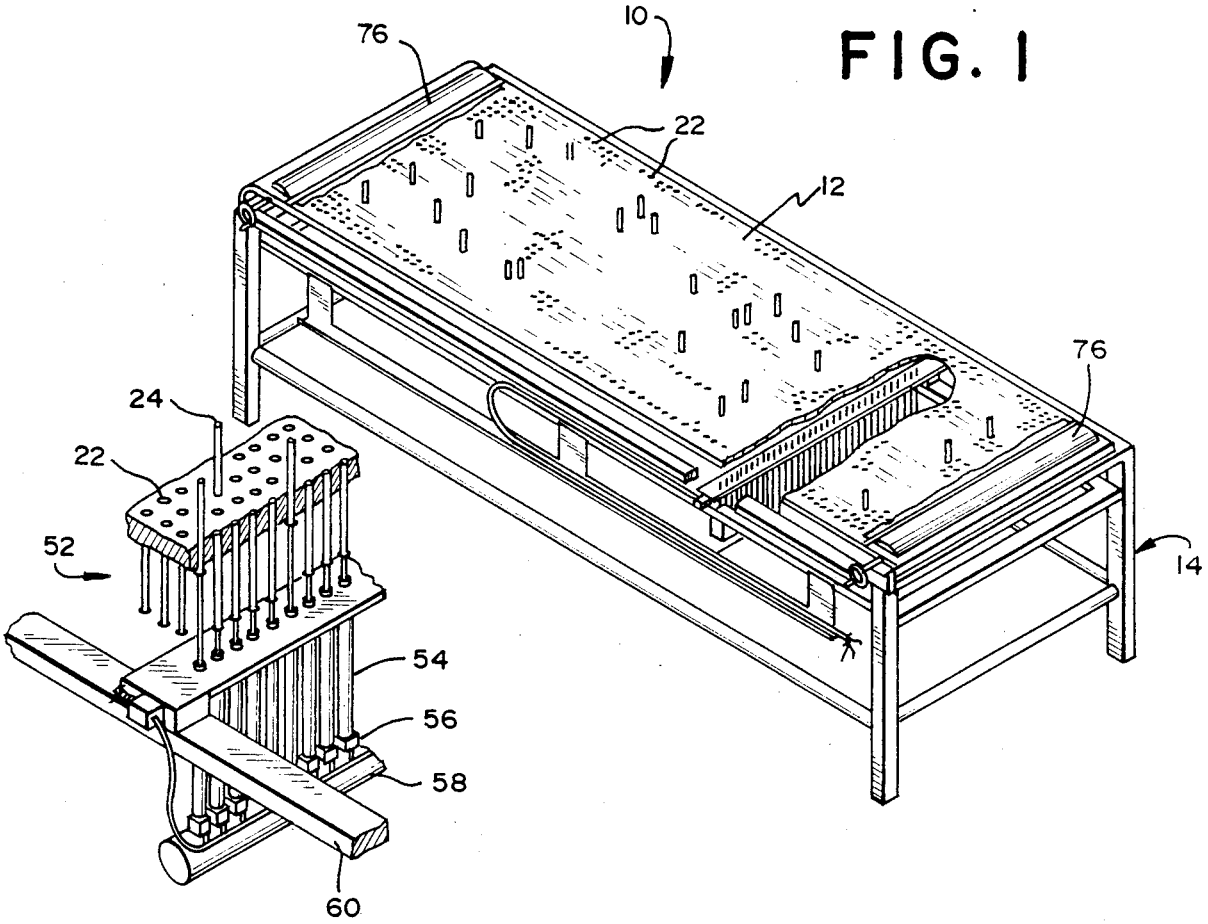
FIG. 1, which is a schematic view in perspective of a form board assembly according to the present invention.
FIG. 3, which is a schematic view in perspective of the actuating assemblY for actuating the routing pins of the form board.

The form board assemblies illustrated in FIGS. 1–9 are universal in their application, i.e., they can be employed to fabricate wire harnesses of different designs requiring different deployment of a set of routing pins mounted to a form board of the assembly.

The single form board assembly in (FIG. 1) and the two form board assembly 100 (FIG. 9), both utilize the structures illustrated in FIGS. 2–8.

A form board 12 is mounted to or forms part of a support frame 14. The form board 12 is preferably rectangular in shape and is constructed to include four edge beams !6 to which a planar plate or table iB is secured, for example by bolts 20. The plate 18 has a plurality of substantially parallel openings 22 formed therein. The openings 22 are situated in a plurality of parallel rows $a_1$–$a_n$ and $b_1$–$b_n$ the rows $a_1$–$a_n$ and $b_1$–$b_n$ form a co-ordinate grid system. The displacement between the openings 22 in the rows $a_1$–$a_n$ and $b_1$–$b_n$ is preferably 1.0 inch between centers.

The edge beams 16 and plate 18 can be made of any structural-type material, either metallic or non-metallic.

Figure 2:
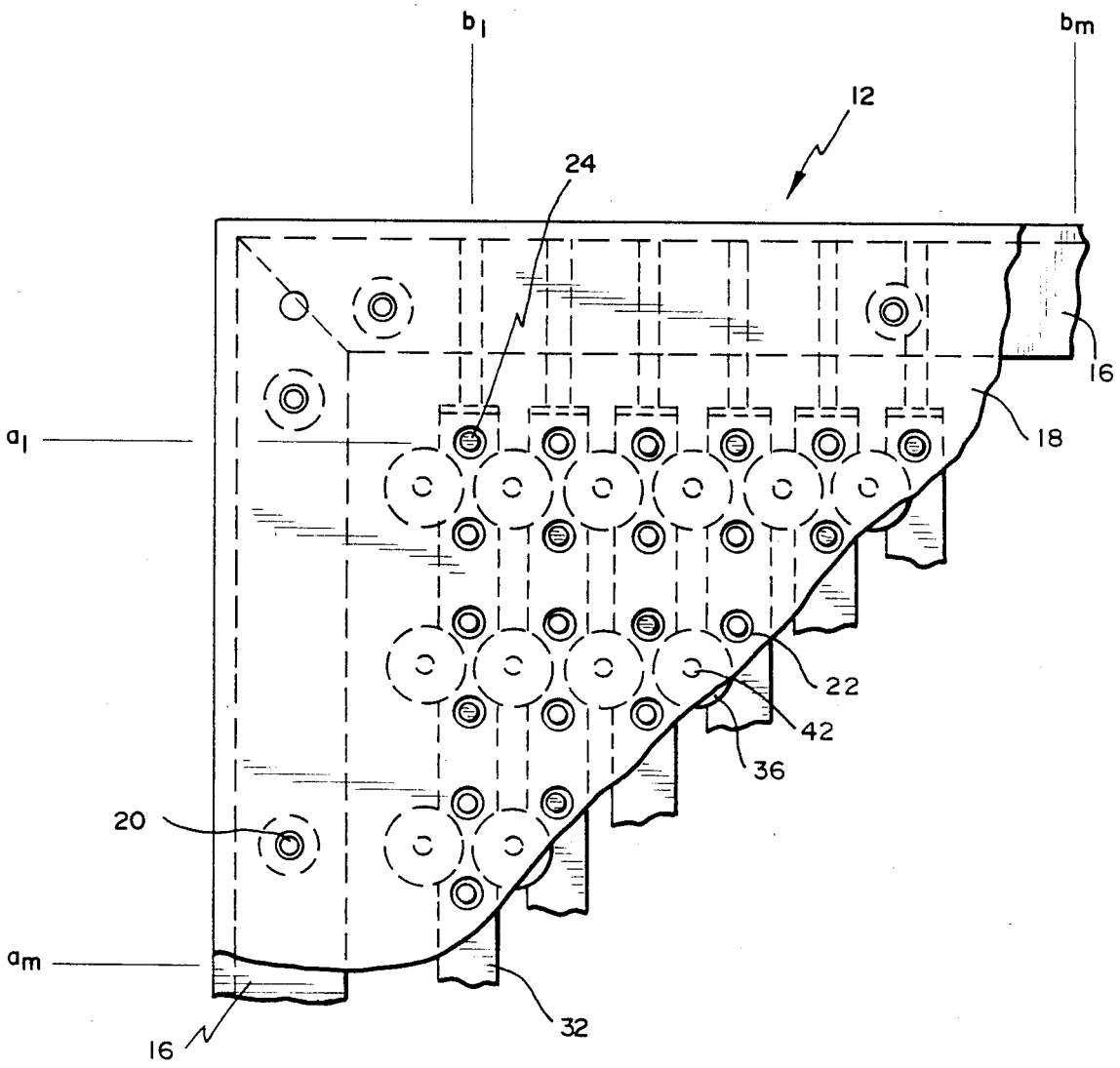
FIG. 2, which is a partial top view of the form board according to the present invention.
Figure 5:
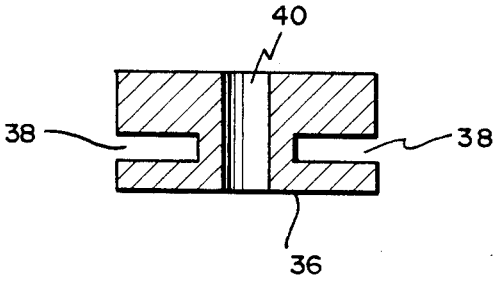
FIG. 5, which is an elevation view of a button guide for the routing pin, locking structure shown in FIG. 2.
Figure 4:
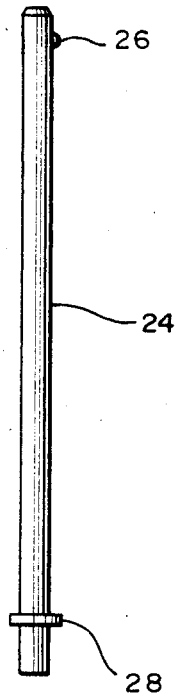
FIG. 4, which is an elevation view of a routing pin mounted with the form board of FIG. 2.
Figure 7:
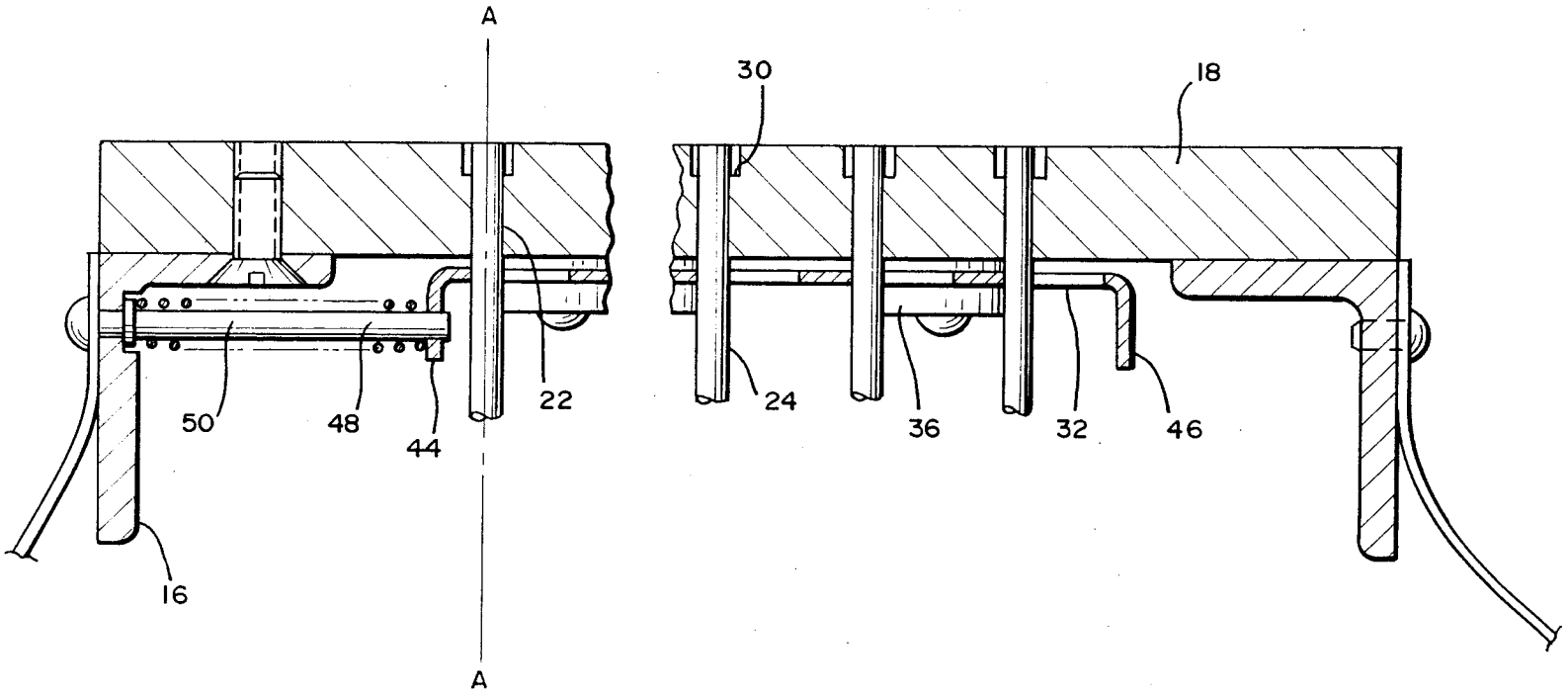
FIG. 7, which is a side view showing the locking structure and the routing pins in their retracted position.

In each of the openings 22, there is situated a routing pin 24 which is reciprocally movable relate to its opening in the direction A—A (FIG. 7). Each pin 24 includes a spring loaded ball lock 26 at one end and a flange 28 at its other end. The spring loaded ball lock 26 engages a shoulder 30 of a recessed portion of the opening 22 defining thereby a retracted position of the pin. While the spring loaded ball lock 26 serves as a stop, the pin can be withdrawn from its associated opening and removed from the board by simply overcoming the spring force. The flange 28 engages a locking plate 32 (FIG. 7) defining thereby an extended position of the pin. The routing pins 24 can be displaced into any height position from its retracted position to its maximum extended position and held or locked in that position. For this purpose, the assembly 10 includes a plurality of locking plates 32. As shown in FIG. 2, the number of locking plates 32 is equal in number to the number of rows $b_1$–$b_n$.

Figure 6:
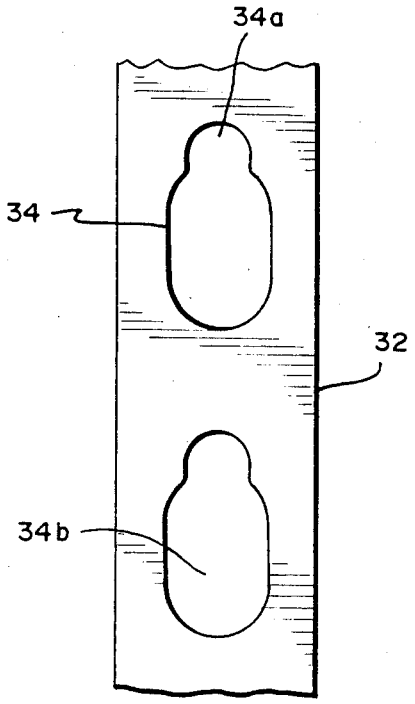
FIG. 6, which is a partial top view of a locking plate of the locking structure shoWn in FIG. 2.

A section of a typical locking plate 32 is shown in FIG. 6. Each locking plate 32 includes a plurality of key-shaped openings 34. The number of openings 34 is equal in number to the number of routing pins in the corresponding row $b_1$ or $b_2$—or $b_n$. The openings 34 have two parts, one part 34*a* having a radius substantially equal to that of its associated routing pin, and another part 34*b* having an opening area greater than the cross sectional area of its associated routing pin.

Each locking plate 32 is mounted by a plurality of button guides 86 arranged as shown in FIG. 2. Each guide 36 includes a pair of spaced slots 38 (FIG. 5) and a bore 40. The bore 40 accommodates a fastening means, such as a bolt 42 for mounting the guide either to the frame 14 or the bottom surface of the plate 18. As shown in FIG. 2, the guides 36 are arranged in rows, with the slots 38 of the guides in adjacent rows forming a track within which an associated locking plate is mounted for reciprocal movement orthogonal to the reciprocal movement of the pins 24 and in a direction of a respective row $b_1$–$b_n$.

At the two ends of each locking plate 32, there is provided a flange 44 and 46 (FIG. 7). The flange 44 mounts one end of a bolt 48 which supports a compression spring 50. The opposite end of the bolt 48 is mounted to the frame 14 or an edge beam 16, as shown in FIG. 7. The flange 46 serves as a reaction surface against which a force is applied to displace the locking plate against the force of the spring 50.

As a result of each locking plate 32, being displaced to the right as shown in FIG. 7, under the influence of the spring 50, each routing pin 24 in an associated row is caused to be received in the part 34*a* of its associated opening 34. When so received the routing pin is held in its selected displaced position, which could be its fully extended position, or any intermediate extended position. To release the pins 24, a force against the flange 46 is applied causing the locking plate 32 to be displaced to the left as shown in FIG. 7 against the force of the spring 50. As a result, each pin 24 in an associated row is then situated in the part 34*b* of its associated opening 34. Because the parts 34*b* are larger in their opening area than the cross-sectional areas of their respective pins 24, the pins 24 drop from their locked position to their retracted position where the spring loaded ball lock 26 engages its associated shoulder 30.

Figure 8:
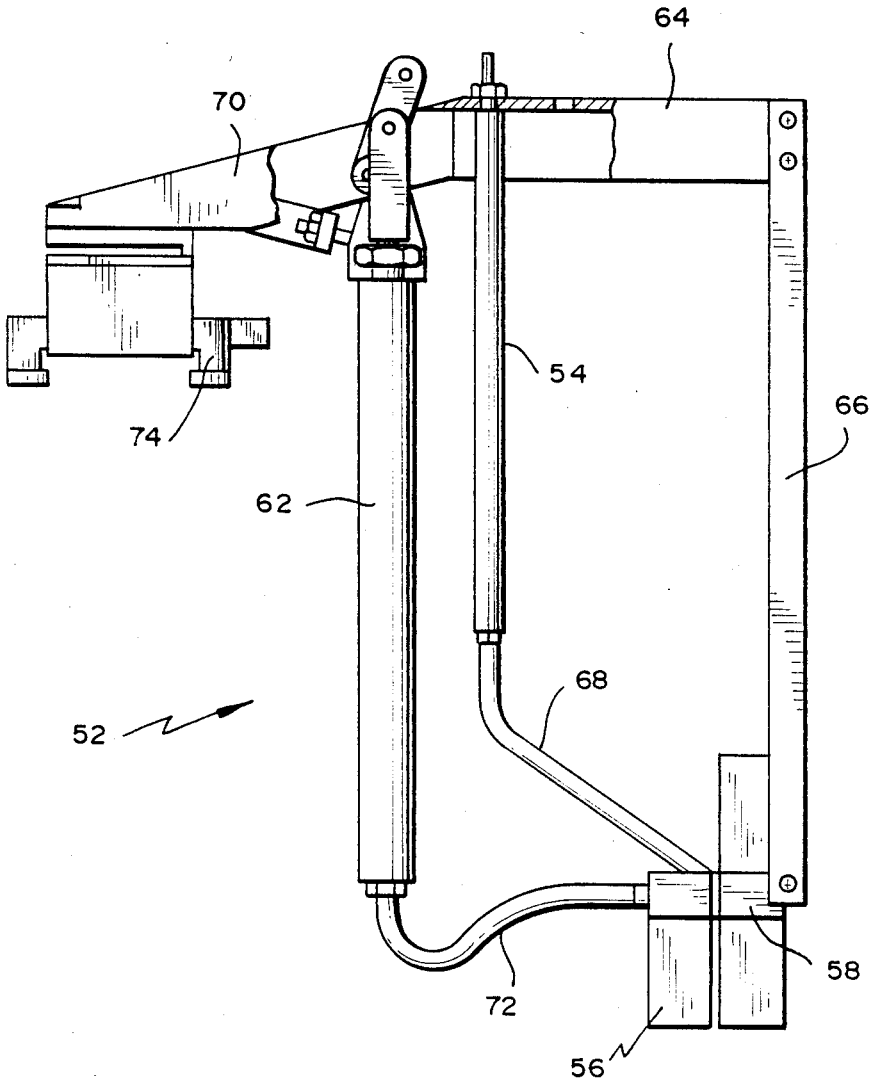
FIG. 8, which is an elevation view illustrating in greater detail the actuating assembly of FIG. 3.

To effect the movement of the routing pins 24 and the locking plates 32, there is provided an actuating assembly 52 (FIGS. 3 and 8). The actuating assembly 52 is mounted to the frame 14 for displacement relative to the form board 12. The actuating assembly 52 comprises a gantry including a plurality of preferably pneumatic cylinders 54 arranged in a row and associated with a respective, preferably pneumatic, valve 56 connected to a manifold 58. The number of cylinders 54 and valves 56 is equal to the number of routing pins 24 in a row $b_1$–$b_n$. The assembly 52 is moved in a direction orthogonal to the direction of movement of the locking plates 32 and in one of the co-ordinate directions, namely between rows $b_1$–$b_n$. Parallel rails 60 (one shown in FIG. 3) mount the assembly 52 and serve to support the assembly during its movement.

As noted above, the illustration in FIG. 3 is schematic. A more detailed view, without the rails 60 and all of the cylinders 54, is shown in FIG. 8. As seen in FIG. 8, the assembly 52 includes in addition to the pneumatic cylinders 54 and pneumatic valves 56, a preferably spring return air cylinder 62, a beam 64 and straps 66, the straps being fastened at one end to the beam 64 and having fastened at their other end the manifold 58. The beam 64 and straps 66 form part of the gantry with the beam 64 being displaceable on the rails 60 (not shown in FIG. 8). The pneumatic cylinders 64 are mounted at one end to the beam 64 and have their other end connected by a flexible tube 68 to their respective pneumatic valve 56. Preferably the air cylinder 62 is mounted at one end to a bracket extension 70 of the beam 64 and has its other end connected by a flexible tube 72 to the manifold 58. The bracket extension 70 also mounts a linear motor 74. The motor 74 serves to move the assembly 52 between successive rows $b_1$–$b_n$.

In operation, the air cylinder 62 pressurizes the manifold 58 up to each pneumatic valve 56, then as the assembly 52 moves from row to row between $b_1$ to $b_n$, the locking plate 32 is moved to the left (FIG. 7) to unlock the routing pins in the particular row, and the valve 56 of a pneumatic cylinder 54 associated with a routing pin 24 that is to be extended is actuated causing the associated pneumatic cylinder to engage and displace the associated routing pin. The locking plate 32 is then moved to the right by the spring 50 locking the routing pins in place. Movement of the various locking plates 32 can be effected manually or by the assembly 52. For this purpose, the assembly 52 includes, for example a cam member (not shown) which engages the flange 46 of the locking plates and applies a force against the flange. Movement of the assembly 52 between the rows $b_1$–$b_n$ is effected by the motor 74 which is indexed for movement, the indexing matching the distance between the rows $b_1$–$b_n$.

Programming of a given pin configuration is accomplished by either digitizing the pin positions off of a wire harness design drawing or by manual keyboard entry of the data into a controller interfaced to a host computer, neither of which are shown. The programs may be stored in the controller's memory or on a floppy disk for instant recall. In the case of a design drawing, the drawing can be stored in one of the cradles 76 mounted at opposed ends of the board 12 (FIG. 1). The drawing is opened and extended across the board 12 to the opposite cradle 76 and held there. The noted digitizing then proceeds. The drawing may also be used in the actual fabrication process. For this purpose, the drawing is typically a mylar drawing and the routing pins are extended and in the process passes through the drawing. With the pins extended and the drawing in place, a fabricator can simply complete the fabrication in accordance with the design illustrated on the mylar drawing. If the design requires extension of less than all the routing pins in a given row of routing pins, those pins are simply retained in their retracted position and not actuated.

Figure 9:
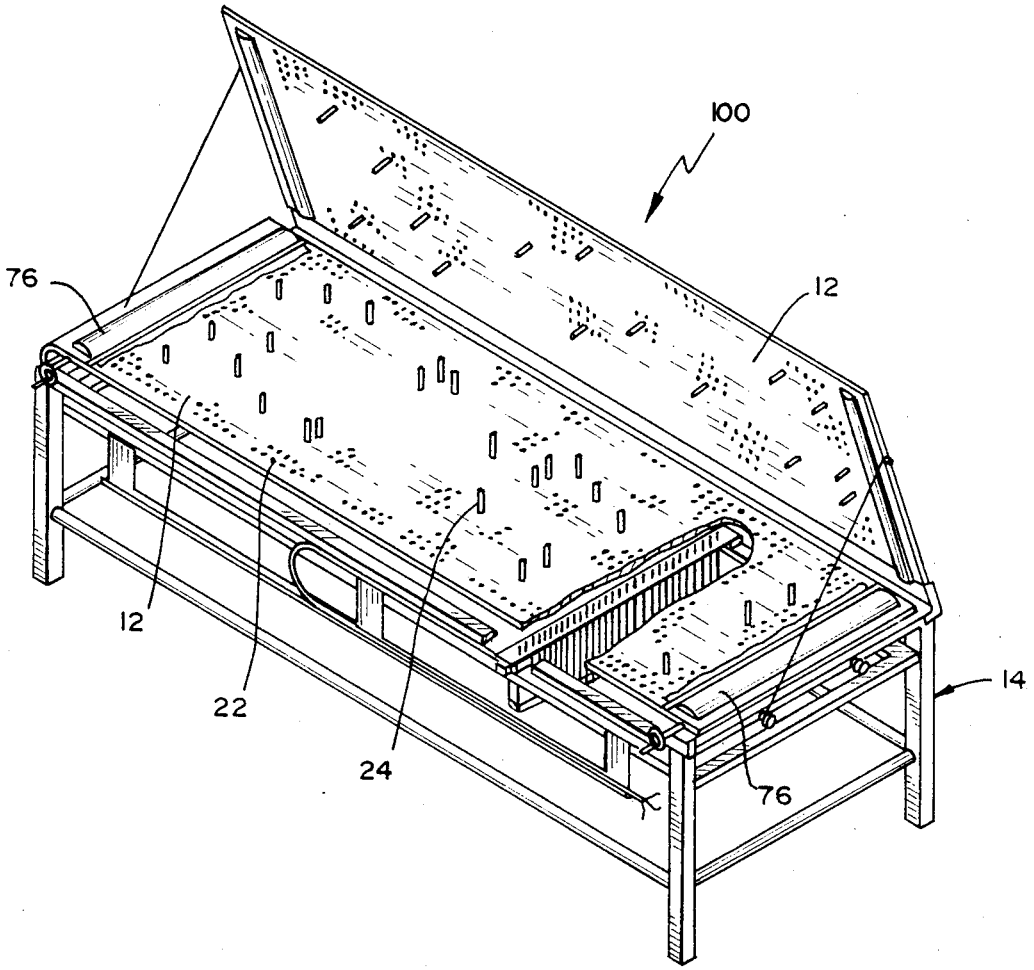
FIG. 9, which is a schematic view in perspective of a form board assembly including two form boards.

The two form board assembly 100 shown in FIG. 9 includes two form boards 12 both pivotably mounted to the frame 14, for example, along one common edge of each board and frame. With two form boards, one form board is in position for fabrication (pivoted up) and the other form board is in position (horizontal) for setting-up the routing pins in accordance with the same or another design.

The universal form board assembly designs according to the present invention eliminate the need for using a unique form board for the lay-up of each wire harness.

Savings are realized by reducing storage, maintenance, set-up and fabrication costs associated with customized form boards.

What is claimed is:

1. A form board assembly for universal wire harness fabrication, comprising:

a board including a plurality of openings;

an equal plurality of routing pins, each situated in a respective one of the plurality of openings and reciprocally movable therein; and actuating means for selectively displacing certain ones of said plurality of routing pins within their respective openings independently of each other and to any of a plurality of selected displaced positions, forming thereby an arrangement of displaced routing pins in accordance with a given wire harness design.

2. The form board assembly as defined in claim 1, further comprising:

locking means for locking the routing pins in a selected displaced position.

3. The form board assembly as defined in claim 2, further comprising:

mounting means for mounting the locking means for displacement relative to the board.

4. The form board assembly as defined in claim 2, wherein the plurality of openings are arranged in a co-ordinate grid system.

5. The form board assembly as defined in claim 1, wherein said actuating means is displaceable relative to said board.

6. The form board assembly as defined in claim 1, wherein the board includes routing pin retaining means disposed in each opening for retaining the routing pin situated in said opening from separating from the board in at least one direction of displacement of said routing pin.

7. The form board assembly as defined in claim 1, further comprising:

a support frame on which the board is mounted, said support frame including guide means for guiding said actuating means in the displacement of said actuating means relative to the board.

8. A form board assembly for universal wire harness fabrication, comprising:

a board including a plurality of openings arranged in a co-ordinate grid system;

an equal plurality of routing pins, each situated in a respective one of the plurality of openings and reciprocally movable therein;

locking means for locking the routing pins in a selected displaced position; and actuating means for selectively displacing certain ones of said plurality of routing pins within their respective openings independently of each other forming thereby an arrangement of displaced routing pins in accordance with a given wire harness design;

said actuating means and said locking means being displaceable in orthogonal directions relative to said co-ordinate grid system.

9. The form board assembly as defined in claim 8, further wherein said actuating means and said locking means extend substantially the full extent of one co-ordinate direction of said co-ordinate grid system.

10. The form board assembly as defined in claim 9, further wherein said locking means includes an elongated plate with a plurality of openings equal to the number of openings in the board in the direction of extent of said actuating means and said locking means, and said actuating means includes a plurality of displacing cylinders equal to the number of routing pins in the direction of extent of said actuating means and said locking means.

11. A form board assembly for universal wire harness fabrication, comprising:

support frame;

two boards each mounted for relative pivotal movement to said support frame, each said board including a plurality of openings and an equal plurality of routing pins, each situated in a respective one of the plurality of openings and reciprocally movable therein; and actuating means for selectively displacing certain ones of said plurality of routing pins in either of said boards within their respective openings independently of each other and to any of a plurality of selected displaced positions, forming thereby an arrangement of displaced routing pins in accordance with a given wire harness fabrication.

12. The form board assembly as defined in claim 11, further comprising:

locking means associated with each board for locking the routing pins thereof in a selected displaced position.

13. The form board assembly as defined in claim 12, wherein further comprising:

mounting means for mounting the locking means associated therewith for displacement relative to the board.

14. The form board assembly as defined in claim 12, wherein the plurality of openings in each board are arranged in a co-ordinate grid system.

15. The form assembly as defined in claim 11, wherein said actuating means is displaced relative to each board.

16. The form board assembly as defined in claim 11, wherein each board includes routing pin retaining means disposed in each opening for retaining the routing pin situated in said opening from separating from the board in at least one direction of displacement of said routing pin.

17. The form board assembly as defined in claim 16, further wherein said support frame includes guide means for guiding said actuating means in the displacement of said actuating means relative to the boards.

18. The form board assembly, as defined in claim 11, wherein each board further including an edge region at which the board is mounted to said support frame for said relative pivotal movement.

19. A form board assembly for universal wire harness fabrication, comprising:

support frame;

two boards each mounted for relative pivotal movement to said support frame, each said board including a plurality of openings arranged in a co-ordinate grid system and an equal plurality of routing pins, each situated in a respective one of the plurality of openings and reciprocally movable therein;

locking means associated with each board for locking the routing pins thereof in a selected displaced position; and actuating means for selectively displacing said plurality of routing pins in either of said boards within their respective openings forming thereby an arrangement of displaced routing pins in accordance with a given wire harness fabrication;

said actuating means and said locking means associated with each board being displaceable in orthogonal directions relative to the co-ordinate grid system of each board.

20. The form board assembly as defined in claim 19 further wherein said actuating means and said locking means associated with each board extend substantially the full extent of one co-ordinate direction of the co-ordinate grid systems.

21. The form board assembly as defined in claim 20, further wherein said locking means associated with each board includes an elongated plate with a plurality of openings equal to the number of openings in the associated board in the direction of extent of said actuating means and said locking means, and said actuating means includes a plurality of displacing cylinders equal to the number of routing pins in the direction of extent of said actuating means and said locking means.

* * * * *